US008021537B2

(12) United States Patent
Sarkar et al.

(10) Patent No.: US 8,021,537 B2
(45) Date of Patent: Sep. 20, 2011

(54) STEAM GENERATION APPARATUS AND METHOD

(75) Inventors: Sujit K. Sarkar, DeWinton (CA); David J. Mitchell, Calgary (CA)

(73) Assignee: ACS Engineering Technologies, Inc., Calgary, AB (CA)

( * ) Notice: Subject to any disclaimer, the term of this patent is extended or adjusted under 35 U.S.C. 154(b) by 1238 days.

(21) Appl. No.: 11/585,163

(22) Filed: Oct. 24, 2006

(65) Prior Publication Data

US 2008/0093264 A1 Apr. 24, 2008

(51) Int. Cl.
*C10G 27/04* (2006.01)

(52) U.S. Cl. ..... 208/41; 208/39

(58) Field of Classification Search ..... 208/41, 208/45; 60/772, 780, 782, 783; 122/1 R, 122/17.2, 1 C
See application file for complete search history.

(56) References Cited

U.S. PATENT DOCUMENTS 6,357,526 B1 * 3/2002 Abdel-Halim et al. .... 166/272.3
6,381,943 B1 * 5/2002 Iijima et al. ..... 60/783
6,990,930 B2 1/2006 Sarkar
2004/0055208 A1 * 3/2004 Chakrabarty et al. ..... 44/301
2005/0218037 A1 10/2005 Pickler et al.

FOREIGN PATENT DOCUMENTS

CA 2265596 3/1998
CA 2332685 9/2001
CA 2419617 8/2004

OTHER PUBLICATIONS

Kaminski, T.J. et al. (2000). Energy & Fuels, 14, 25-30.*

* cited by examiner

*Primary Examiner* — Robert J Hill, Jr.
*Assistant Examiner* — Brian McCaig
(74) *Attorney, Agent, or Firm* — Diederiks & Whitelaw PLC

(57) ABSTRACT

The present invention provides for steam generation replacing natural gas with a selected refined product of a feedstock of bitumen, asphaltenes or heavy oil using locally produced surplus bitumen, asphaltene or heavy oil, separating the asphaltenes and other components of the feedstock for use in providing a liquid fuel for steam generation. The lighter products from the separation equipment not used for liquid fuel may be blended into the produced bitumen, asphaltenes or heavy oil, to increase its API gravity and reduce the diluent required for transportation. This technology may be employed in open pit mining operations for the generation of steam and power. The refined components of the feedstock used to provide liquid fuel are selected to optimize energy output balancing planned energy demand against the value of the components of the feedstock used.

19 Claims, 13 Drawing Sheets

SYMBOLOGY

INSTRUMENT

- TC — TEMPERATURE CONTROLLER
- FC — FLOW CONTROLLER
- PC — PRESSURE CONTROLLER
- LC — LEVEL CONTROLLER
- TI — TEMPERATURE INDICATOR
- FI — FLOW INDICATOR
- PI — PRESSURE INDICATOR
- LI — LEVEL INDICATOR
- FRC — FLOW RATIO CONTROLLER
- AC — ANALYZER CONTROLLER

MISC.

- STREAM DIRECTION
- STREAM LINE
- INSTRUMENT LINE
- STREAM NUMBER
- CONTROL VALVE
- MANUAL VALVE

FIG. 12

STEAM GENERATION APPARATUS AND METHOD

FIELD OF THE INVENTION

The present invention relates to a steam generator and in particular to a steam generation apparatus and method replacing natural gas as fuel with a selected portion of bitumen, asphaltenes or heavy oil optimised for desired energy or steam production.

BACKGROUND OF THE INVENTION

Steam is often used in industrial processes. For example, steam can be used for heat exchange, as a power source for driving turbines, etc.

In the petroleum industry, for example, a particular application is for the generation of steam for the recovery of bitumen or heavy oil. A common process utilized for the in situ recovery of heavy oil or bitumen is to inject steam underground pursuant to which the viscosity of bitumen or heavy oil is decreased such that it flows and is capable of being pumped to the surface. For this, steam generation apparatus commonly called steam injection boilers ("SIB") are used to generate steam of the required/desired quality or quantities. These boilers are typically fired with natural gas (which is piped to the boiler) in order to heat water to generate the desired steam.

The current art typically uses natural gas as the fuel to fire most oilfield steam generation boilers. For in situ recovery of bitumen or heavy oil, prominent processes utilized are steam assisted gravity drainage ("SAGD") and cyclic steam stimulation ("CSS"). The SAGD process is presently the most commonly used process for recent and new projects due to its enhanced efficacy in the recovery of bitumen or heavy oil. Generally, 80% quality steam is required/desired to be generated by the boiler in specified volumes per hour depending on output capabilities of the boiler, as well as steam output requirements for the recovery and extraction process. Exceeding 80% quality renders a project uneconomical, largely due to water treatment costs. Conversely, lower than 80% quality steam introduces inefficiencies to the process utilized for heavy oil or bitumen recovery and, hence, is also undesirable from a cost-effectiveness perspective. Typically the quality of the steam will degrade as heat exchange surfaces foul over the run time of the equipment.

Typical problems generally encountered under conventional steam generation boilers include (but are not limited to):

(a) failure to maintain 80% quality steam (or such other quality of steam as required or desired) at the outlet of the boiler—often lower quality steam is generated; and (b) cost of fuel, typically natural gas, to fire the boilers used for steam generation (plus the cost of associated pipeline construction and maintenance to bring the natural gas or other fuel to the boiler).

In addition, problems typical for pipeline transport of produced bitumen include that the availability and handling of diluent increases the overall cost of transporting the bitumen to upgrading facilities, pipelines are required to return diluent to the production facility, and electrical power required at the production facility and pipeline facilities often requires expensive transmission lines from the power host or supplier.

It has been proposed previously to convert to other fuels so that propane or light fuel oils could be utilized to fire the boilers instead of natural gas. However, as with natural gas, a source for the propane or light fuel oils would need to be located nearby in order to be piped to the boiler, thus increasing costs. Moreover, the heat input to the boiler will change due to the difference in the energy density of the new fuels, resulting in a drop in the steam quality and/or the production of less steam and, in turn, less heavy oil or bitumen being produced. Liquid fuels will create a longer flame, in other words, of different shape than that for which the combustion chamber was designed and built to accommodate. As such, existing boilers will have to be derated such that existing fire boxes can be utilized to accommodate the differently shaped flame when liquid fuel is used.

Moreover, an alternative processes which utilize solvents instead of steam to reduce the viscosity of heavy oil or bitumen is presently being employed for the recovery and extraction of heavy oil and bitumen. However, while possessing the advantage that it does not require natural gas for firing the boiler or for that matter the boiler (and related ancillary equipment) or the water which is heated to create steam, still must overcome a significant cost disadvantage relative to the SAGD and CSS processes for recovering and extracting heavy oil or bitumen.

Canadian patent application No. 2,419,617, published Aug. 21, 2004, teaches a method for enabling the use of a "heavy oil residuum" by converting it to a useful product. The method involves the use of a heavy oil residuum which is substantially non flowable. The viscosity of the residuum is reduced by the application of heat and use of a diluent. This method appears to suggest the use of a diluent to reduce viscosity of the residuum, and the making of an emulsion with the heavier residuum, and subsequently with water, and then burning the resultant product to produce energy as heat. The burning of the residuum emulsion results in a net energy contribution from the residuum's combustion.

United States Publication no. US 2005/0218037 published Oct. 6, 2005, teaches a system for heating multiphase residues containing water, oil and solids to obtain hydrocarbons and other useful products. This system comprises a tubular reactor provided with a fixed pitch screw conveyor where the multiphase residue is heated under reduced pressure and in the presence of an inert gas, the heating being carried out in distinct temperature zones with a first zone of evaporation of free and emulsified water and extraction of light hydrocarbons, a second zone of thermal desorption and a third zone of mild pyrolysis, the various hydrocarbon fractions being collected in condensers at the relevant stages, while the solids are separated for post-treatment and industrial use.

SUMMARY OF THE INVENTION

The present invention provides a steam generation apparatus for replacing natural gas as the fuel for firing a boiler with a liquid fuel comprised at least in part by bitumen, asphaltenes or heavy oil that may be locally produced, while maintaining the net undesirable emissions arising from the combustion of heavy oil or bitumen to a level which are within current environmental guidelines and legislation, and constantly and consistently producing 80% quality steam or such other quality of steam as may be required or desired. The liquid fuel includes a variable and energy/cost optimized component of bitumen, asphaltenes or heavy oil, which may be locally produced.

The present invention provides a steam generation apparatus which uses bitumen or heavy oil produced from the field in order to separate heavier ends of the produced hydrocarbons for use as fuel. The lighter products from the included separation equipment are blended into the produced bitumen, thus also increasing the API gravity of the mixed material and reducing the amount of diluent required for pipeline transportation. The technology may be employed by existing open pit mining operations for the generation of steam and power by burning asphaltenes or bitumen components rather than natural gas.

In accordance with a broad aspect of the present invention, there is provided a steam generation apparatus replacing natural gas as fuel with a liquid fuel from a component of a feedstock, the feedstock being bitumen, asphaltene or heavy oil, comprising a refinery for separating products from the feedstock, some of the products to be used to provide the liquid fuel; a steam generation subsystem fueled at least in part by the liquid fuel; a product tank system for storing the products from the refinery with a delivery system to deliver selected components of the products to parts of the apparatus, particularly those of the products used to provide the liquid fuel.

In accordance with another broad aspect of the present invention, there is provided a steam generation apparatus where the refinery is provided with the ability to separate and produce several different products such as produced gas vapour, condensates, gas oil or vacuum gas oil draws depending upon the makeup of the feedstock, with the bottom product of the tower being an asphaltene, where, in a preferred embodiment, the modulation of the energy output is done by adjustment of the refinery's output of asphaltene or other product to adjust the amount and nature of the liquid fuel provided by the asphaltene or other product.

In accordance with another broad aspect of the present invention, a method of generating energy in the form of steam is provided using liquid fuel from a component of a feedstock, the feedstock being bitumen, asphaltene, or heavy oil, comprising the steps of in a refinery, separating products from the feedstock, some of the products to be used to provide the liquid fuel, in a steam generation subsystem, burning the liquid fuel, through a product tank system for storing the products from the refinery using a delivery system to deliver selected components of the products to parts of the apparatus, particularly those of the products used to provide the liquid fuel to fire the steam generation operation, and in a preferred embodiment, where the refinery is provided with the ability to separate and produce several different products such as produced gas vapour, condensates, gas oil or vacuum gas oil draws depending upon the makeup of the feedstock, with the bottom product of the tower being an asphaltene, and in another embodiment, where the modulation of the energy output is done by adjustment of the refinery's output of asphaltene or other product to adjust the amount and nature of the liquid fuel provided by the asphaltene or other product.

In accordance with another aspect of the present invention, lighter portions of the products of the refinery are added to produced bitumen, asphaltenes or heavy oil as diluent for reducing the produced material's viscosity in order to facilitate a reduction in the amount of extraneously provided diluent required to meet pipeline specifications for transport, and which in another embodiment also provides for the use of generated power (whether heat in steam or electrical power generated from produced steam or otherwise) to provide heat to surface equipment to increase efficiencies in cold ambient temperatures or which also provides for the use of power (whether heat in steam or electrical) to elevate pipeline temperatures to reduce diluent requirements in dilbit by reducing viscosity with temperature increase of pipeline (and included dilbit).

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore exemplary and descriptive but are not to be considered limiting of its scope. In the drawings:

FIG. 12 illustrates instrument and miscellaneous symbology employed in the drawings.

DETAILED DESCRIPTION OF THE INVENTION

The present invention generally comprises bitumen feed surge vessel, heat exchanger system, a heater, a vacuum tower, an off-gas compressor, product tankage, and flow control system, a steam generation system, a power generation system, and a flare system.

It is to be understood that the description following is an embodiment of the present invention, is descriptive and exemplary but no limiting, and that there are substitutions and replacements of certain process equipment or process steps which will be apparent to those skilled in the art, and which are claimed as part of this invention.

Bitumen Feed Surge Drum

Figure 1:
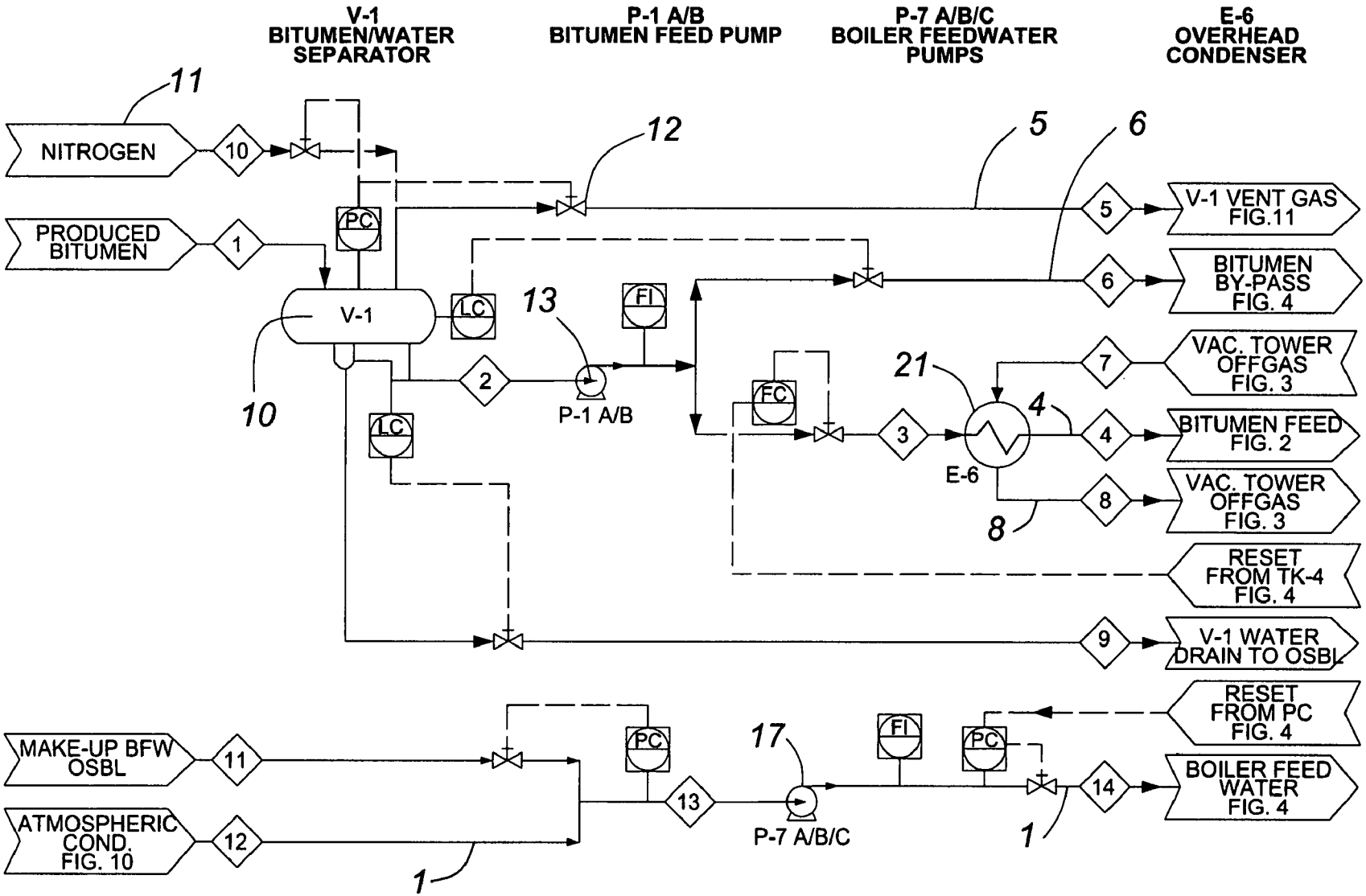
FIG. 1 is a partial schematic showing a feed drum and pumps of the present invention.
Figure 4:
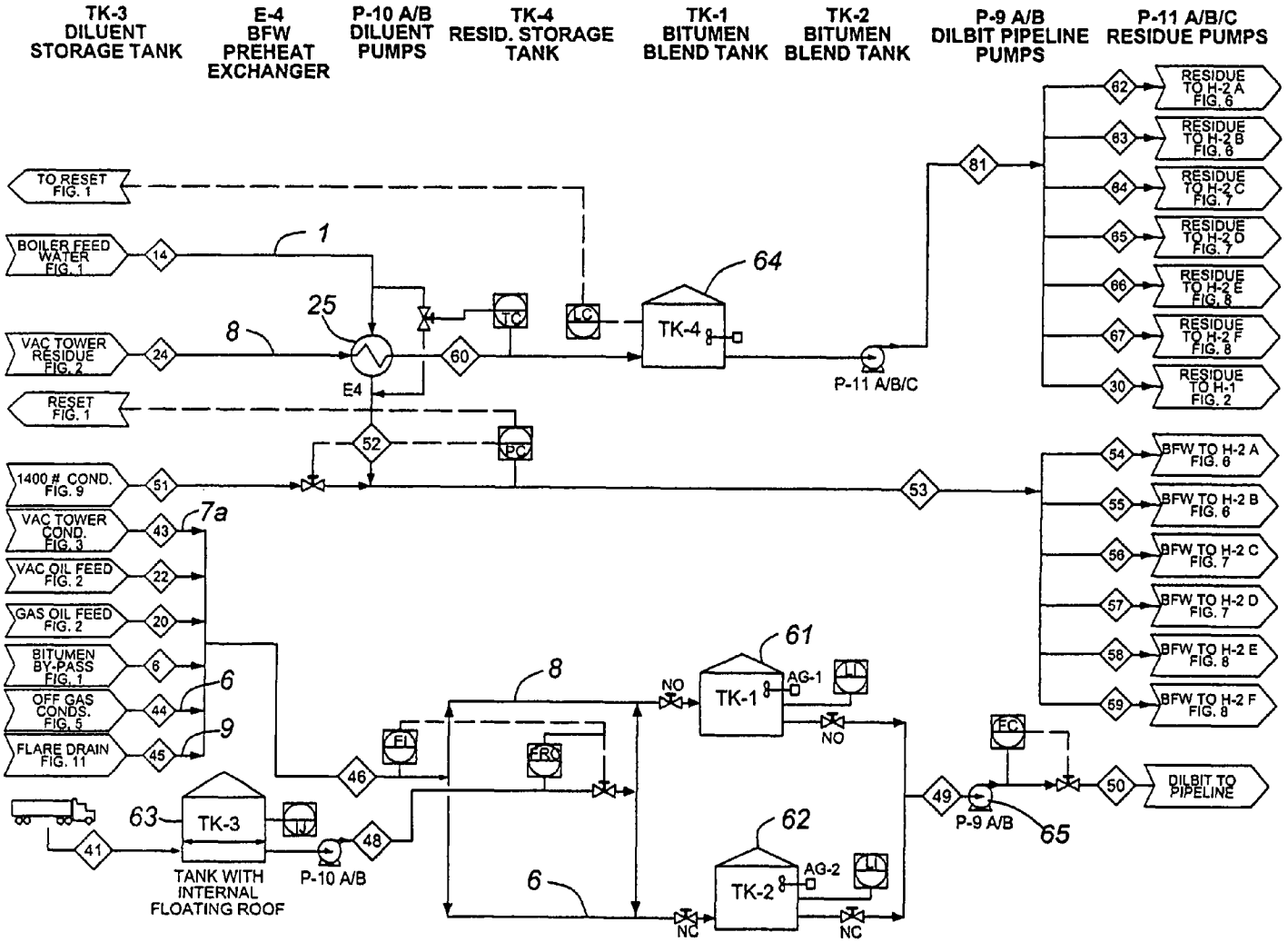
FIG. 4 is a partial schematic showing the blending and storage tanks of the present invention.

Referring to FIG. 1, in this embodiment bitumen is dewatered utilizing standard SAGD equipment prior to entering through a feed surge drum 10 through supply line 1. The feed surge drum 10 has an internal baffle (not shown) and a boot for water separation. The boot on the drum 10 will be controlled with an interface level control. The drum 10 is purged with nitrogen 11 for pressure control on the drum 10. The drum 10 ideally does not produce significant amounts of hydrocarbon vapour off the drum 10 because of the low operating temperature. Any small amount of hydrocarbon vapours is safely disposed of in the closed flare system through valve 12. The drum 10 also provides the ability to automatically bypass produced bitumen from the drum 10 to bitumen blend tanks 61 or 62 through line 6 as shown in FIG. 4. A bitumen feed pump 13 provide the pressure to deliver the bitumen to two locations. The primary feed line 4 will be flow controlled through the feed heat exchangers 21, 22, 23, 24 and through a heater 30 (asphaltene fired) and into a vacuum tower 40. The flow rate of the bitumen into the exchanger train is set by matching the firing requirements of the heaters with the asphaltene production from the bottom of tower 40. The level in the Residual Storage tank 64 will automatically reset the flow into the exchanger train to maintain the balance. The secondary line 6 will bypass the vacuum tower 40 for blending with the vacuum gas oils and then sent to the bitumen blend tanks 61 and 62.

Feed Heat Exchange Train

Figure 2:
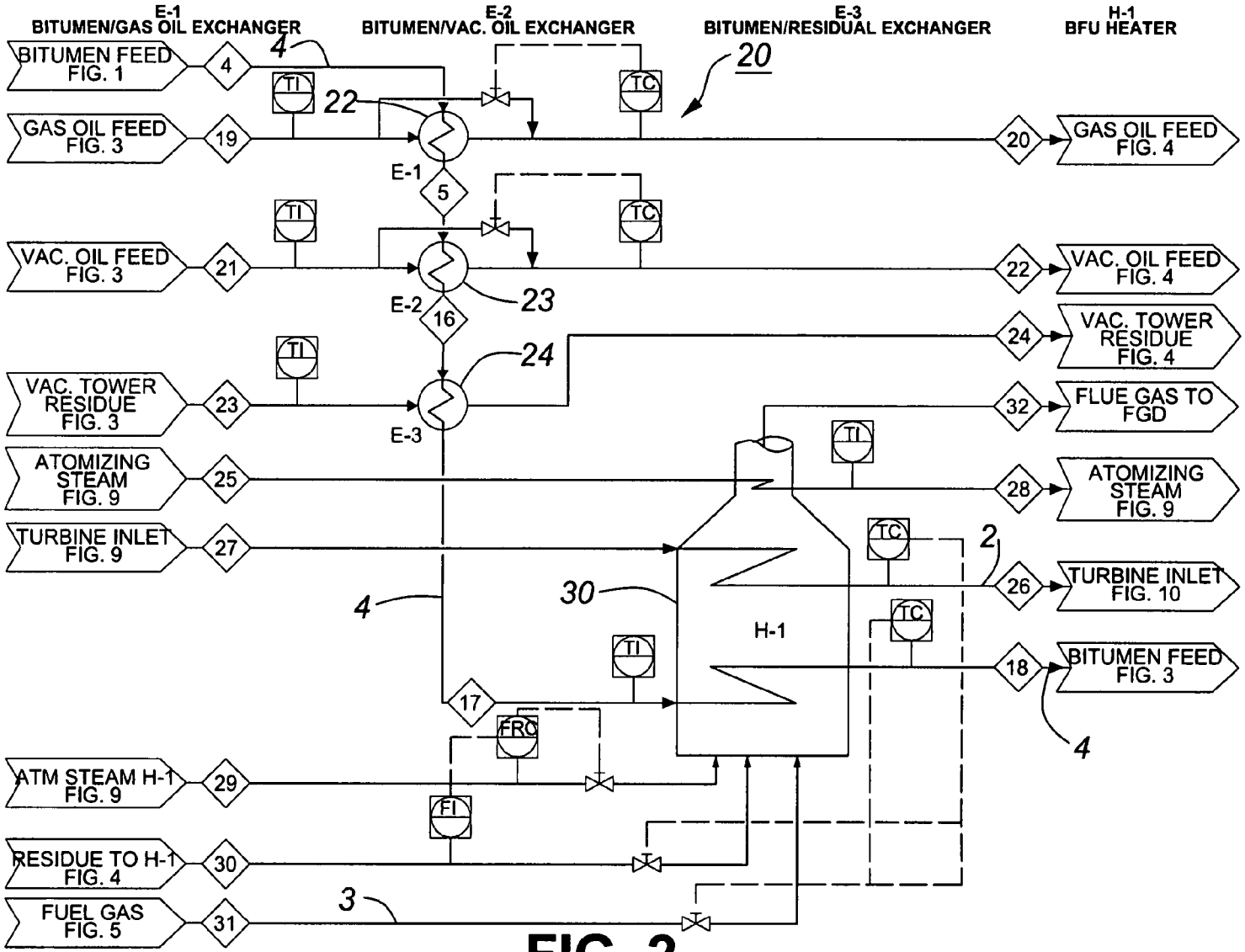
FIG. 2 is a partial schematic showing heat exchangers and an alternate application of the heater described in the prior art.

Referring to FIGS. 1 and 2, in this embodiment, the bitumen enters a heat exchanger system 20 essentially dry. The heat exchanger system 20 consists of four series. First exchanger 21 in the series will be used as a pre-condenser for the Vacuum column overheads.

Second exchanger 22 in the series preheats the bitumen against the gas oil product. Third exchanger 23 in the system is a cross between the vacuum gas oil and the bitumen. Fourth exchanger 24 in the series is a cross between the asphaltenes and the bitumen. The heat exchanger train takes advantage of the available heat in the system in order to minimize the energy requirements of the BFU heater 30.

BFU Heater

Figure 3:
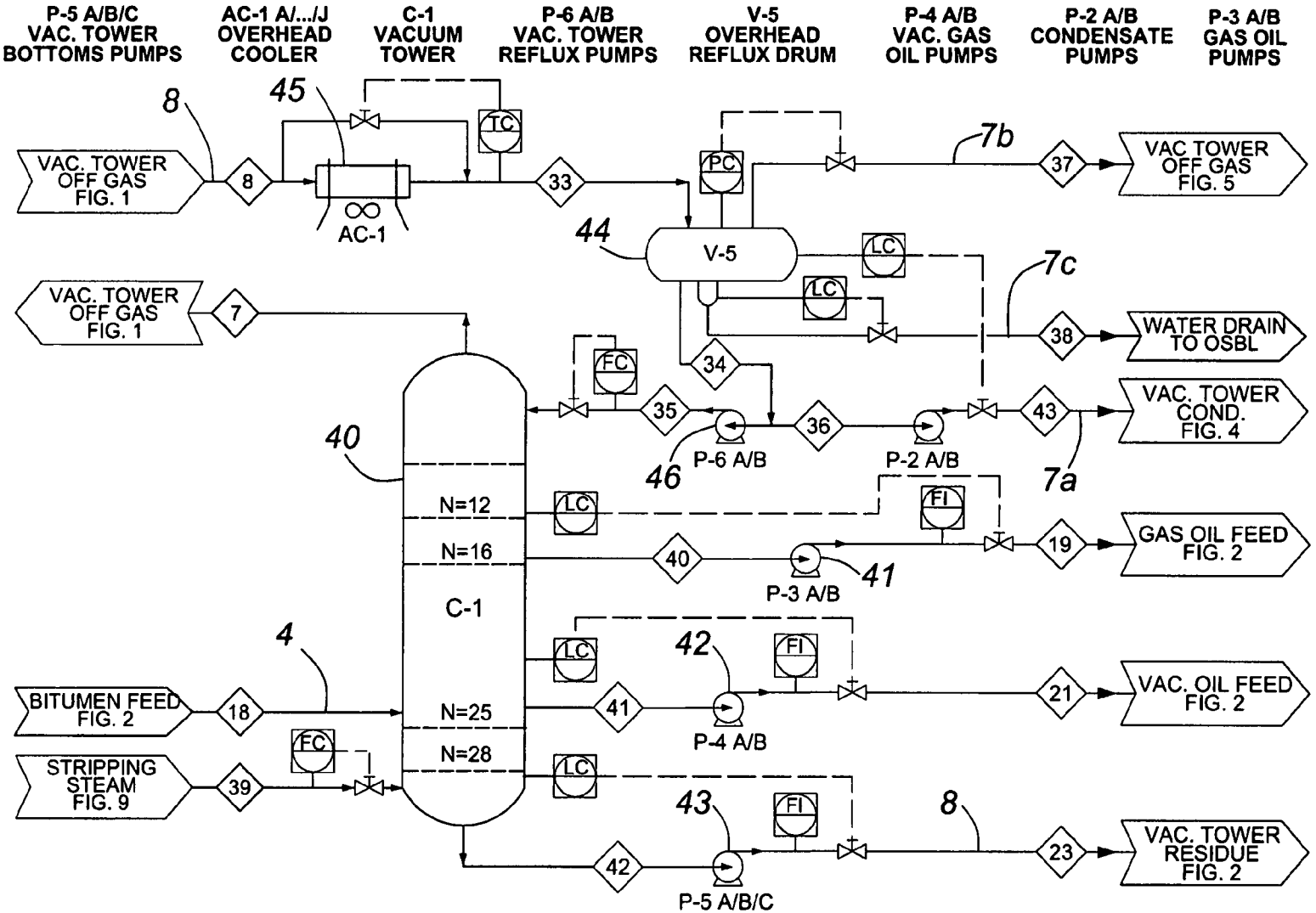
FIG. 3 is a partial schematic showing a vacuum tower and pumps of the present invention.

Referring to FIGS. 2 and 3, a BFU heater 30 has been completely described in U.S. Pat. No. 6,990,930. In this embodiment, the BFU heater 30 has been adopted for use within a vacuum column system. The temperature of the bitumen entering a vacuum tower 40 is controlled on the outlet of the BFU heater 30. The temperature of the bitumen may be controlled by adjusting the flow rate of the asphaltenes entering the burners. The atomizing steam flow rate is flow controlled based on a fixed ratio with the asphaltenes flow. Hydrocarbon gas produced from the vacuum tower 40 may also be burned in the BFU heater 30. The BFU heater 30 can have other services in addition to heating the bitumen. A first service is to superheat low pressure atomizing steam, a second service is to superheat high-pressure steam for power generation, and a third service is to share duty with the OTSG (Once Through Steam Generators) for higher steam quality. The merits of providing or using these various services would be determined based on individual project requirements.

Vacuum Tower

Referring to FIGS. 3 and 4, in this embodiment, a refining step is taken using a vacuum tower 40, which is primarily used to separate the asphaltenes from the balance of the gas oils and fuel gas contained in the bitumen feed. Stripping steam is used to enhance separation efficiency. The steam is controlled at a desired flow rate. The ratio of steam to bitumen is typical for refinery vacuum tower 40 applications.

There are typically a number of products that are removed from the vacuum tower 40 during and resulting from its processing of the bitumen feedstock. Asphaltenes are removed from the bottom of the vacuum tower 40. Vacuum gas oil (VGO) and gas oil (GO) are removed from middle of the vacuum tower 40. Condensate is removed as a liquid product from a reflux drum 44. These three products are cooled though heat exchangers 22, 23 and 24 against the incoming bitumen, combined and pumped by pumps 41, 42 and 43 to the bitumen blend the tanks 61, 62. Vacuum tower bottoms are pumped into the Resid Storage Tank 64. The product temperature of the gas oil and vacuum gas oil may be controlled with a bypass. This will maintain a constant or desired velocity on the bitumen side of the heat exchangers 22, 23 and 24 for fouling control and prevention considerations.

The vacuum tower 40 overheads are pre-cooled against the bitumen through exchanger 21 on line 8 and then further condensed in an overhead condenser 45. The vacuum tower overhead temperature is controlled with a hot gas bypass around the overhead condenser 45. The internal pressure in the column is controlled with a back pressure control into the suction of the off gas compressor 51 shown in FIG. 5 though line 7*b*.

The two phase overhead product is separated in the overhead reflux drum 44. The vacuum tower reflux pump 46 returns the reflux back to the top of the vacuum tower 40 under flow control. The condensate product is removed from the overhead reflux drum 44 under level control, blended with the VGO and GO and pumped to tanks 61 and 62 through line 7*a*.

Water is separated in the boot of the overhead reflux drum 44 and is sent through line 7 *c* to the unit battery limit for treatment in offsite facilities. The level in the boot is controlled with an interface level control (not shown). The requirement for a water pump will be determined as required for a specific project needs.

The vapour product off the reflux drum 44 is compressed in down stream equipment and then used as fuel gas for the heater 30 and flare header sweep gas.

Asphaltenes are removed from the bottom of the vacuum tower 40 and are pumped by pump 43 into a product tank 64 for storage through line 8. The temperature of asphaltenes entering the product tank 64 will be controlled by bypassing a portion of the BFW (Boiler Feed Water) around the heat exchanger 25. This will allow a relatively constant continuous flow of asphaltene through the exchanger 25 such that minimum velocity can be maintained for control and prevention of fouling considerations.

Off Gas Compressor

Figure 5:
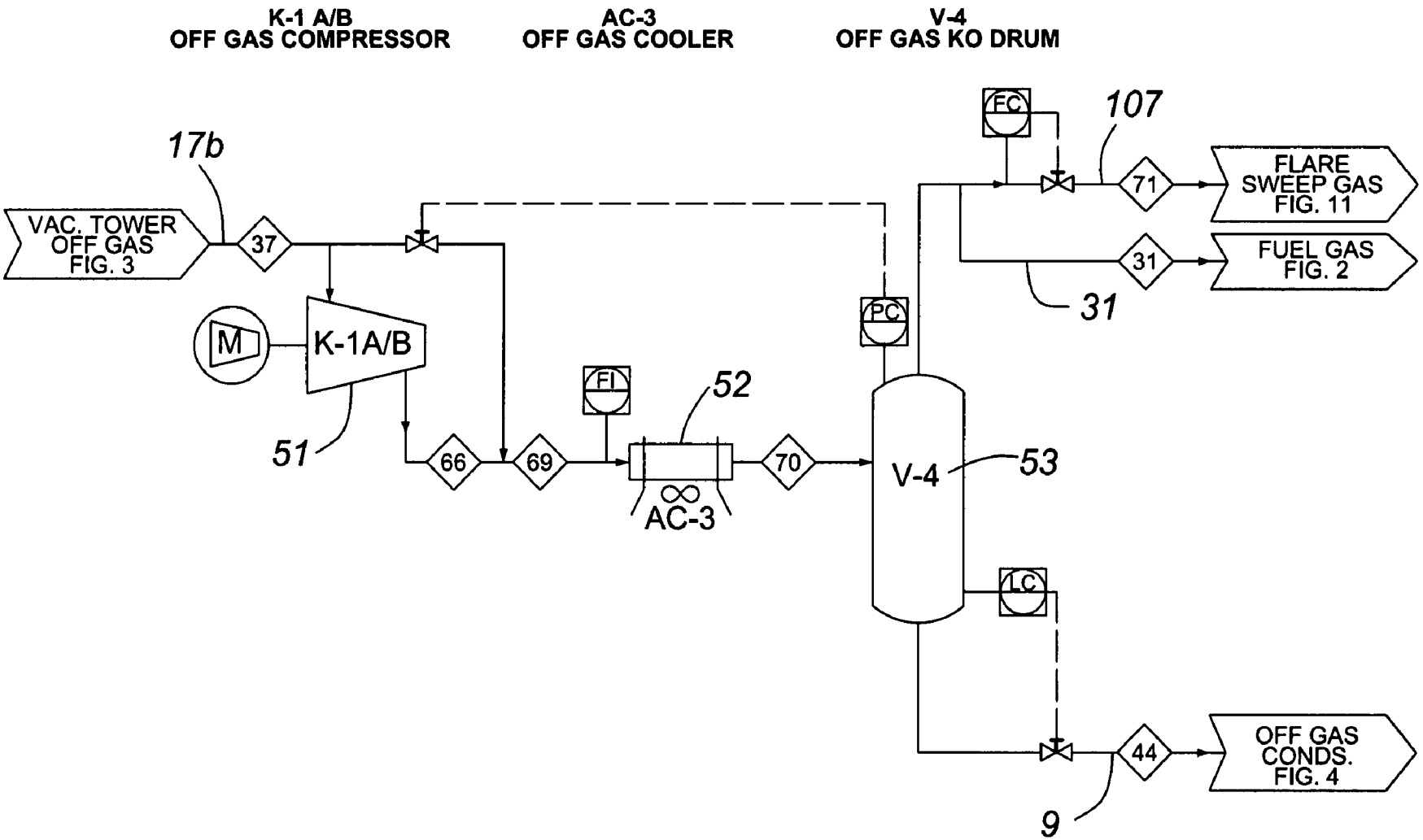
FIG. 5 is a partial schematic showing an off-gas compressor system within the present invention.
Figure 6:
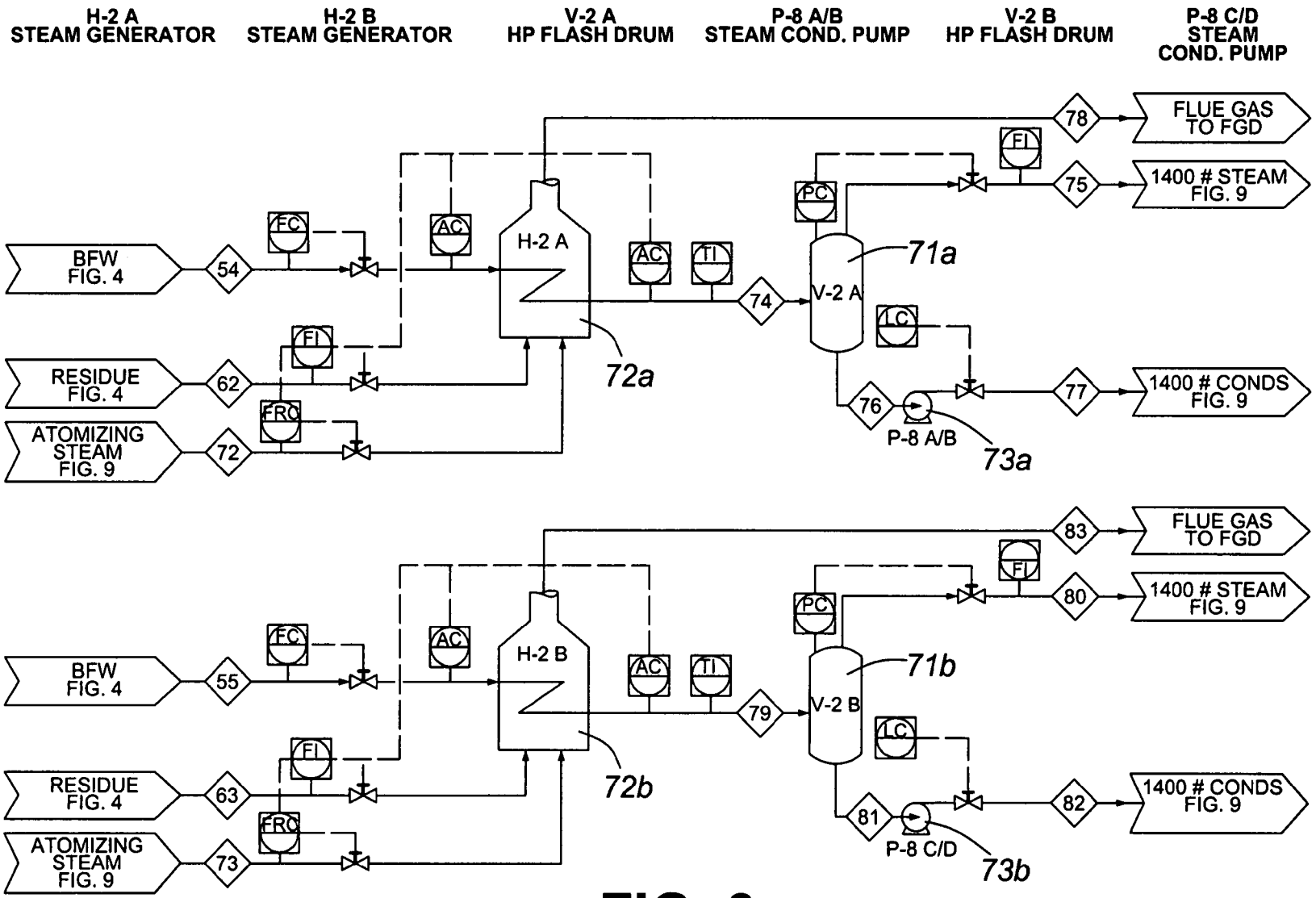
FIG. 6 is a partial schematic showing the Bitumen Firing Unit steam generator of the prior art, and flash drums of the system, configured for use in accordance with the present invention.
Figure 7:
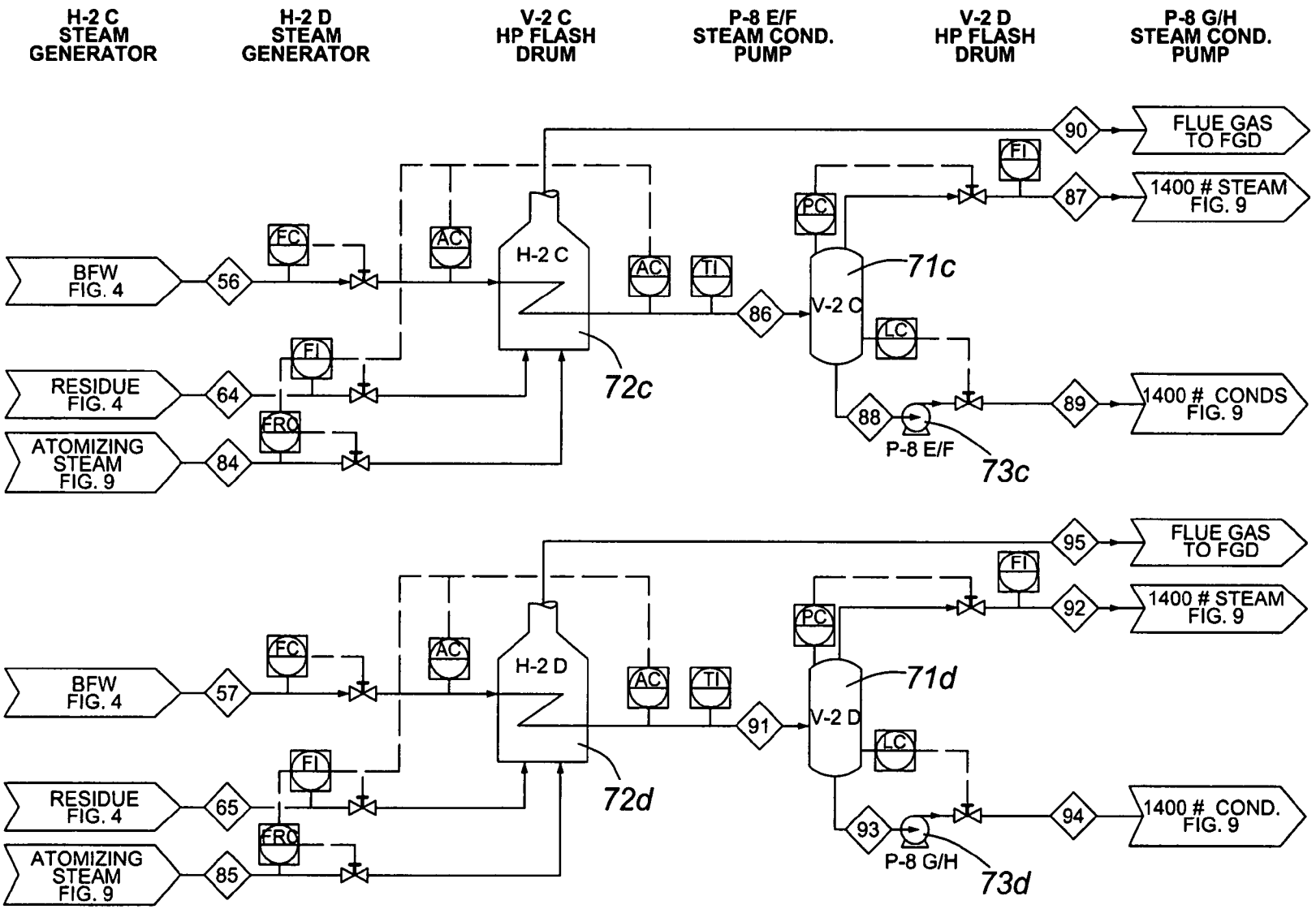
FIG. 7 is a partial schematic showing a Bitumen Firing Unit steam generator and flash drums configured for use within the present invention.
Figure 8:
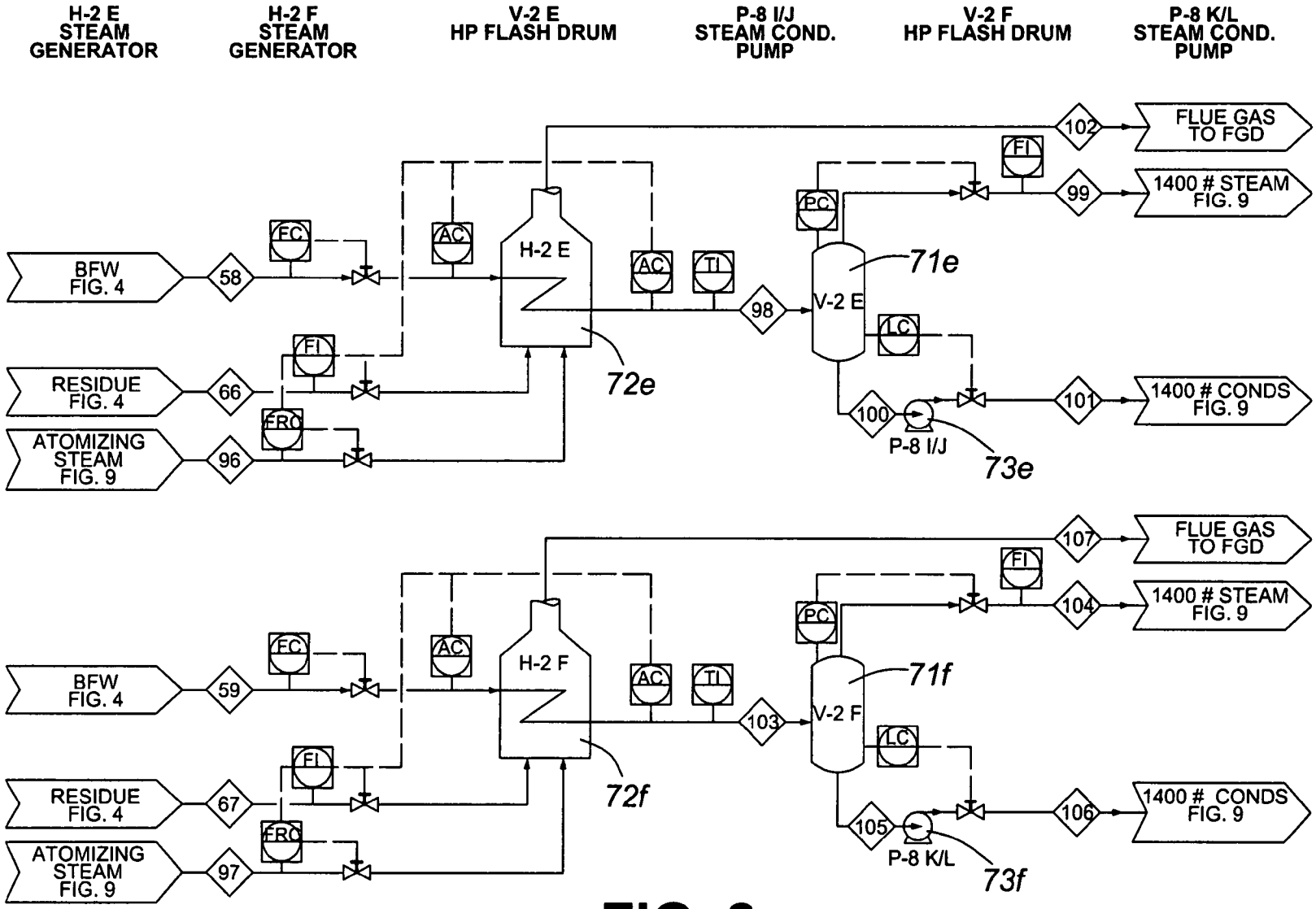
FIG. 8 is a partial schematic showing the Bitumen Firing Unit steam generator and flash drums configured for use within the present invention.
Figure 9:
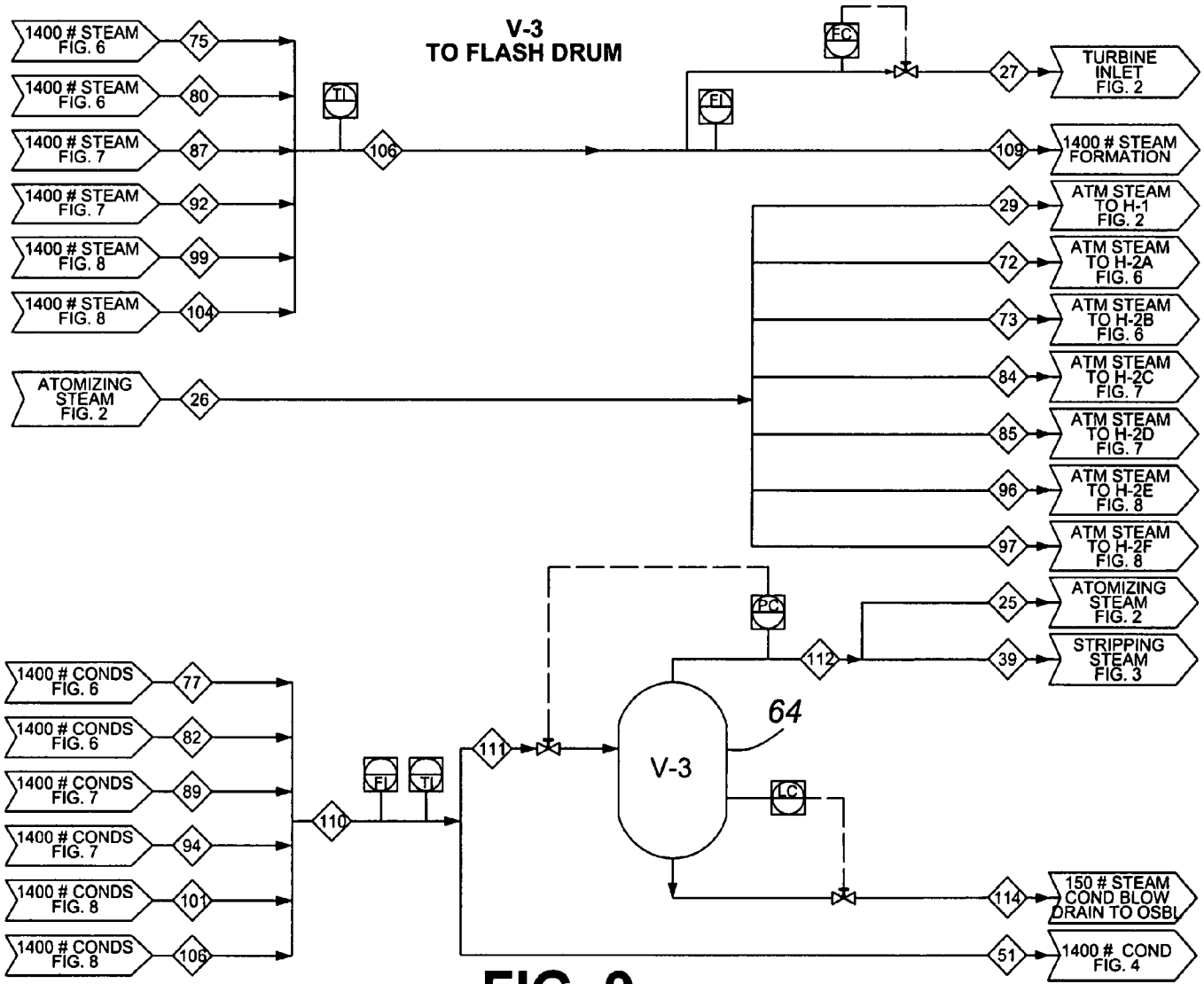
FIG. 9 is a partial schematic showing the low pressure steam flash drum of the present invention.

Referring to FIG. 5, the off gas compressor 51 has two main functions: one is as a vacuum source for the vacuum tower 40; and the other is to increase the discharge pressure of the fuel gas to acceptable levels.

An off gas cooler 52 and off gas knock out drum 53 are included in this embodiment. The Knock out drum 53 will typically be a two phase separator. The compressed fuel gas will used as fuel in the heater 30 though line 31 and flare header sweep gas though line 107. The condensed hydrocarbons will be blended with the condensate from the reflux drum 44 and used to increase the API of the blended bitumen.

Product Tanks

Four 40,000 bbl product tanks 61, 62, 63 and 64 typically are specified for a facility. In this embodiment, tanks 61 and 62 will be used as day tanks for the blending of gas oil, vacuum gas oil, condensate, diluent and bitumen. The blending will occur on-line and agitators have been included in the tanks 61, 62 to ensure uniformity of the dilbit. Additional storage space within the tank has been provided for quality control prior to transferring the dilbit into the pipeline. The tanks 61 and 62 can be used as emergency storage for produced bitumen. The tank 63 is a floating roof tank for diluent storage. The asphaltene fuel system will be designed with a continuously circulating system to ensure that the lines remain flowing.

Steam Generation Equipment

Referring to FIG. 6 through FIG. 9, desired steam generation 70 is the result of a balance between asphaltene production from the bottom of vacuum tower 40 and over-all system demand for steam production, for example: formation stimulation, power generation or process use, more typically a mixed set of those uses. The flow rate of bitumen into the vacuum tower 40 is set to maintain that balance. Fluctuations in the energy balance can be accommodated by the surge time in the storage tank 64.

For example, boiler feed water of appropriate quality for 1600 psig steam will typically be available from offsite facilities. A boiler feed water pump 17 has been included to increase the pressure of the boiler feed water appropriate to the required steam pressure. The boiler feed water flowed though line 1 to the heat exchanger 24 will be preheated against the vacuum tower asphaltenes.

Steam is generated using a combination of once-through steam generator and separately fired coils within the heater 72*a*-72*f*. The once-through steam generator and the heater coils will be fired with asphaltenes and/or fuel gas. Based on project requirements, the fired equipment may be designed for multiple fuel applications, i.e. asphaltenes, bitumen or natural gas. This flexibility may be required for start-up purposes if there is no source of stored heavy fuel or if energy demands fluctuate or costs are such that the energy capable of being provided by asphaltenes alone is sub-optimal. The combination of once-through steam generator and the heater 30 will produce steam consistently at 80% quality without up-grading typical water treatment facilities.

Flash drums 71*a*-71*f* are shown here for each of the steam generators 72*a*-72*f*. The condensate that is recovered from the high pressure flash drums 71*a*-71*f* is pumped by pumps 73*a*-73*f* back to the inlet of the once-through steam generator and heater 72*a*-72*f*.

High pressure condensate is also let down to 150 psig as a source for generating low pressure steam. A flash drum 64 has been provided as the knock-out drum for generating the 150 psig steam. Condensate from the flash drum 64 is used as the continuous blow down for the steam system. This condensate is sent to the unit battery limit for disposal offsite. The 150 psig steam is flow controlled into the vacuum tower 40 for stripping steam. The low pressure steam is also superheated in the heater and used for atomizing steam.

Power Generation Equipment

Figure 10:
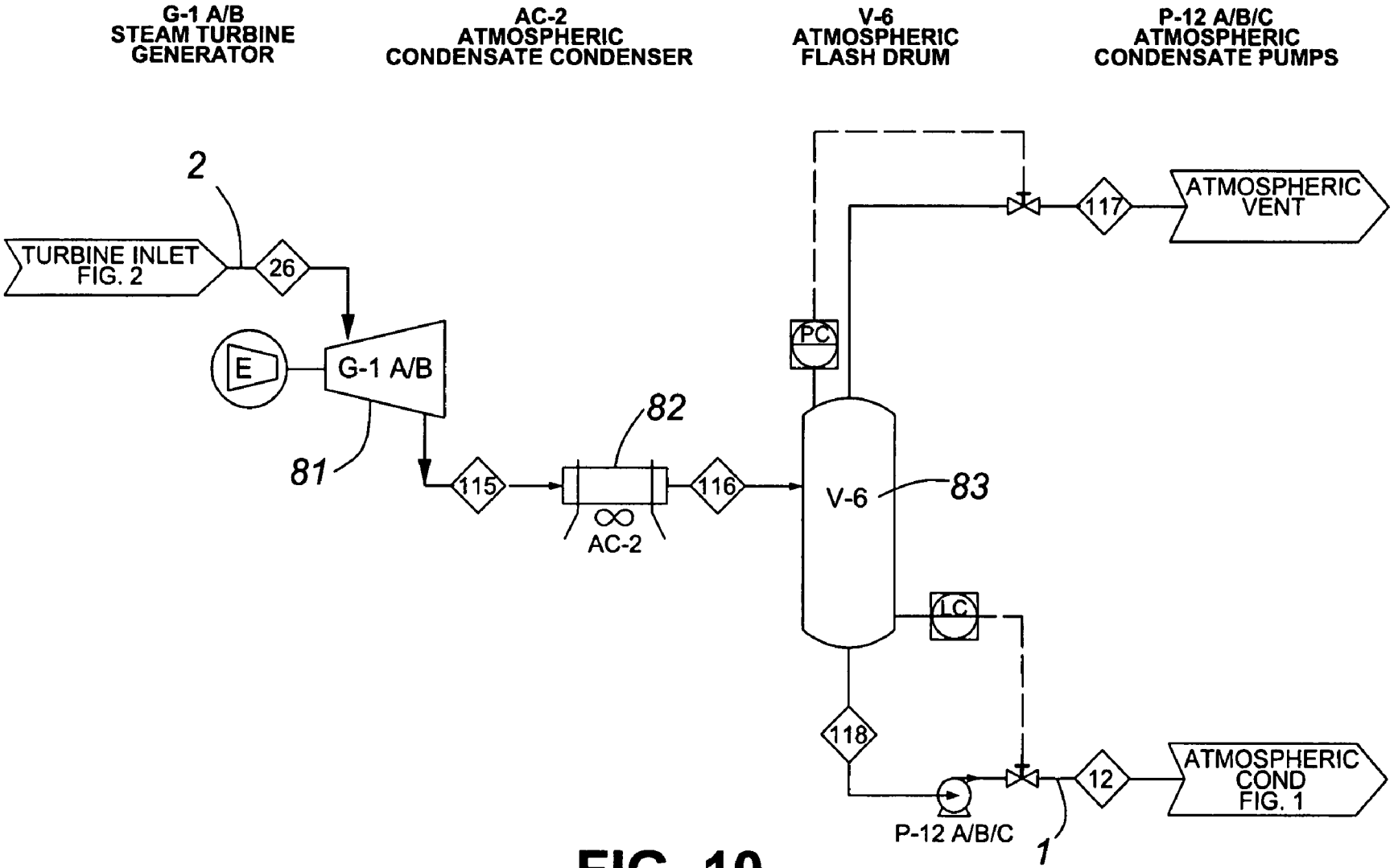
FIG. 10 is a partial schematic showing the power generation system of the present invention.

Referring to FIG. 10, power generation equipment 80 has been provided to power all the electrical needs for the equipment described. Additional power generation can be accommodated based on desired energy outputs. Adjustments can be made to the design of the vacuum tower 40 such that additional asphaltenes can be separated from the bitumen and used in the production of steam. This adjustment to the heat and refining balance can have at least some of the following material benefits: First, a SAGD facility can become an island with no incoming transmission lines; and Second, a SAGD facility could be a net exporter of power depending upon the ability to sell or use the excess power; and last, additional condensate, gas oil and vacuum gas oil is produced and can be used as diluent components to further reduce bitumen viscosity bringing a further net reduction in diluent and diluent support requirements and associated costs and facility complexity.

For example, dry, high pressure steam is superheated in a separate coil in the heater 30. The high pressure superheated steam is then used in a condensing steam turbine generator 81 though line 2 to generate the necessary power. It is also possible that an extraction turbine could be specified as an alternative to generating the lower pressure steam. The condensate from the steam turbine generator is further cooled in a surface condenser and vapours removed in a downstream atmospheric flash drum 83. The lower pressure condensate is pumped back to the boiler feed water feed pump 17 and used as blow down from the steam system.

Flare

Figure 11:
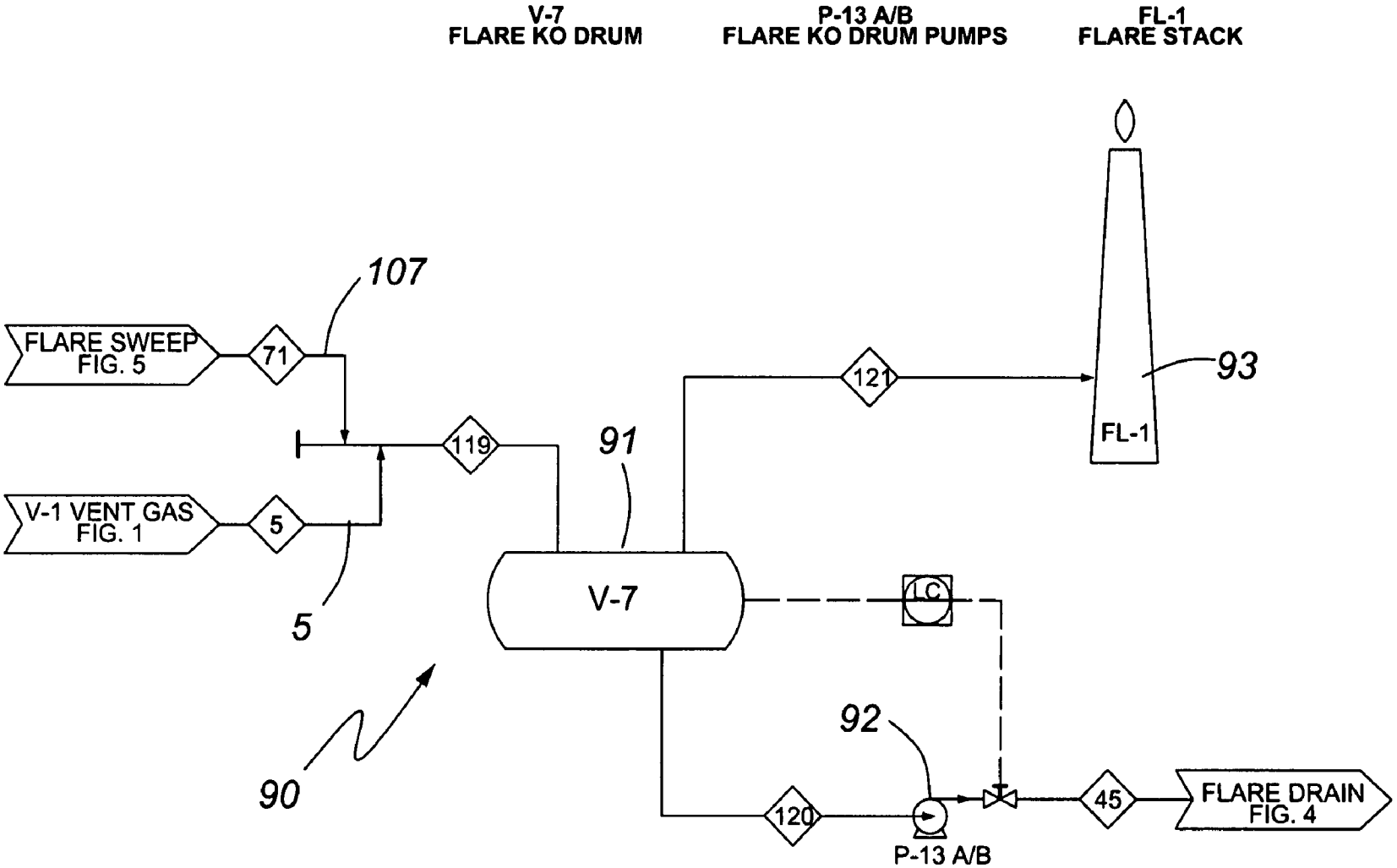
FIG. 11 is a partial schematic showing the flare system of the present invention.
Figure 13:
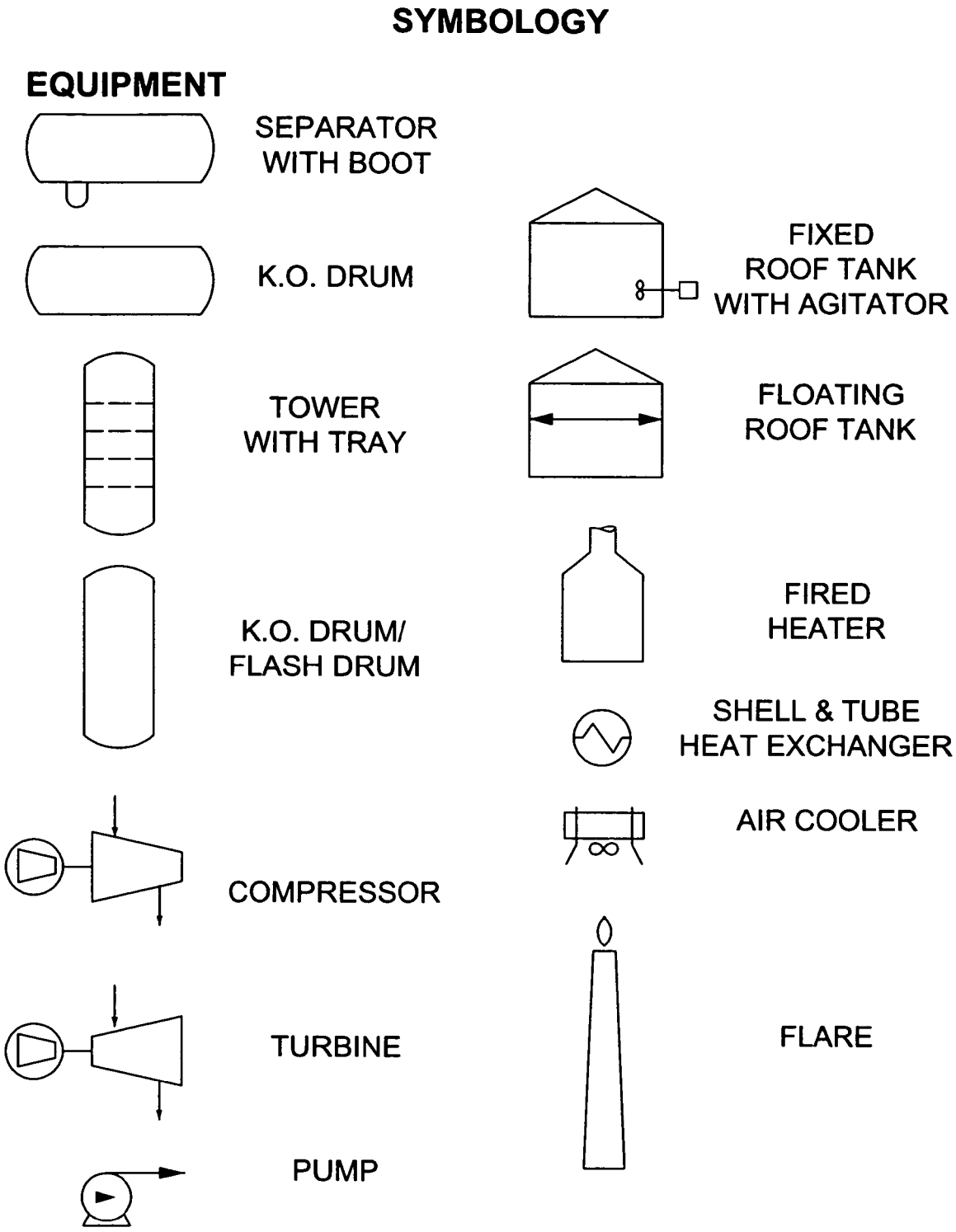
FIG. 13 illustrates equipment symbology employed in the drawings.

Referring to FIG. 11, vessels in hydrocarbon service will be protected from overpressure with a closed flare system 90. The Flare system 90 will be designed based on API RP 521. The flare system in a preferred embodiment will include the flare distribution system, a knock out drum 91, a knock out drum pumps 92 and a flare stack 93. Liquids collected in the knock out drum can be returned to the feed surge drum.

What is claimed is:

1. A steam generation apparatus, comprising:

a refinery configured to separate bitumen feedstock into products including gas vapour, condensates, gas oil, vacuum gas oil draws and an asphaltene;

a process fired heater configured to burn the gas vapours to directly heat the feedstock;

a steam generation subsystem configured to be fueled at least in part by a liquid fuel formed from at least the asphaltene; and a product tank system configured to store the products from the refinery, said product tank system including a delivery system configured to deliver the liquid fuel to the steam generation subsystem and to deliver the gas vapour to the process fired heater.

2. The steam generation apparatus of claim 1 where the refinery is a vacuum tower and associated equipment.

3. The apparatus of claim 2 where the vacuum tower is configured to separate several different amounts of each of the products depending upon a makeup of the feedstock.

4. The apparatus of claim 3 where the liquid fuel includes an amount of each of the products separated from the feedstock which optimizes energy output from the steam generation apparatus and balances energy demand against a value of each of the products included in the liquid fuel.

5. The apparatus of claim 3 further comprising a line for adding the gas vapour, the condensates, the gas oil or the vacuum gas oil draws to reduce a viscosity of the asphaltene in order to facilitate a reduction in an amount of extraneously provided diluent required to meet pipeline specifications for transport of the produced asphaltene.

6. The steam generation apparatus of claim 1 where the refinery uses an asphaltene solvent extraction process.

7. The apparatus of claim 1 further comprising a heat exchanger to provide heat to surface equipment to increase efficiencies in cold ambient temperatures.

8. The apparatus of claim 1 further comprising a line for the delivery of power to equipment to elevate pipeline temperatures to reduce diluent requirements in dilbit by reducing viscosity with temperature increase of pipeline.

9. The apparatus of claim 1 further comprising a controller configured to modulate energy output by adjustment of the refinery's output to adjust the liquid fuel.

10. A method of generating energy in the form of steam with a steam generating apparatus using liquid fuel from a component of a between feedstock, comprising the steps of:

separating the feedstock into products including at least gas vapour, condensates, gas oil, vacuum gas oil draws and an asphaltene in a refinery;

burning the gas vapours in a process fired heater to directly heat the feedstock;

forming a liquid fuel from at least the asphaltene;

delivering the liquid fuel to a steam generation subsystem; and burning the liquid fuel in the steam generation subsystem.

11. The method of claim 10 where the refining takes place in a vacuum tower.

12. The method of claim 10 further comprising using an asphaltene solvent extraction process in the refinery.

13. The method of claim 10 wherein separating the feedstock includes separating and producing several different products depending upon a makeup of the feedstock.

14. The method of claim 10 further comprising choosing different products separated in the refinery as the liquid fuel and selecting an amount of each of the products separated from the feedstock.

15. The method of claim 14 wherein choosing the different products includes optimizing energy output from the steam generation subsystem and balancing energy demand against a value of the products included in the liquid fuel.

16. The method of claim 10 further comprising adding gas vapour, condensates, gas oil and vacuum gas oil draws to reduce a viscosity in order to facilitate a reduction in an amount of extraneously provided diluent required to meet pipeline specifications for transport of the produced asphaltene.

17. The method of claim 10 further comprising heating surface equipment to increase efficiencies in cold ambient temperatures.

18. The method of claim 10 further comprising elevating pipeline temperatures to reduce diluent requirements in dilbit by reducing viscosity.

19. The method of claim 10 further comprising modulating energy by adjustment of the refinery's output to adjust the liquid fuel.

* * * * *